US006230516B1

(12) United States Patent
Andonian

(10) Patent No.: US 6,230,516 B1
(45) Date of Patent: May 15, 2001

(54) APPARATUS FOR MIXING A MULTIPLE CONSTITUENT LIQUID INTO A CONTAINER AND METHOD

(75) Inventor: Martin D. Andonian, South Dartmouth, MA (US)

(73) Assignee: Andonian Family Nominee Trust, Lexington, MA (US)

( * ) Notice: Subject to any disclaimer, the term of this patent is extended or adjusted under 35 U.S.C. 154(b) by 0 days.

(21) Appl. No.: 09/498,511

(22) Filed: Feb. 4, 2000

(51) Int. Cl.[7] ..... F17C 1/100; F17C 13/02; F17C 7/02

(52) U.S. Cl. ..... 62/461; 62/49.2; 62/50.1

(58) Field of Search ..... 62/45.1, 46.1, 62/48.1, 49.1, 49.2, 50.1

(56) References Cited

U.S. PATENT DOCUMENTS

| | | | | |
|---|---|---|---|---|
| 2,502,184 | * | 3/1950 | Thayer et al. | 62/49.1 |
| 2,645,907 | * | 7/1953 | Droste et al. | 62/49.2 |
| 3,371,497 | | 3/1968 | Singleton | 62/45 |
| 3,717,006 | | 2/1973 | Kimmel et al. | 62/48 |
| 3,830,073 | | 8/1974 | Cappiello | 62/17 |
| 3,838,576 | | 10/1974 | Geffs | 62/45 |
| 4,918,927 | | 4/1990 | Eigenbrod | 62/45.1 |
| 5,357,758 | | 10/1994 | Andonian | 62/45.1 |
| 5,819,544 | | 10/1998 | Andonian | 62/50.6 |

* cited by examiner

*Primary Examiner*—William Doerrler
(74) *Attorney, Agent, or Firm*—Hodgson Russ LLP

(57) ABSTRACT

A container for holding a cryogenic, two constituent liquid, is described. The container has two vent conduits disposed at different altitudes or levels inside the container wherein a first, cryogenic liquid is filled into the container until it vents from the first conduit. Then, a second, cryogenic liquid is filled into the container until the combined liquids vent through the second conduit. The vent conduits are preferably positioned to provide intended percentages of the various constituents comprising the liquid.

26 Claims, 4 Drawing Sheets

APPARATUS FOR MIXING A MULTIPLE CONSTITUENT LIQUID INTO A CONTAINER AND METHOD

BACKGROUND OF THE INFORMATION

1. Field of the Invention

The present invention generally relates to a container holding a liquid and, more particularly, to a mixing container holding at least two liquid constituents in intended proportions. In a preferred form of the present invention, the liquid held in the mixing container is a breathable, cryogenic liquid.

To provide the breathable, cryogenic liquid, a first liquid constituent, predominantly comprising either oxygen or nitrogen, is loaded into the mixing container until it occupies that percentage of the total interior volume intended to hold liquid corresponding approximately to the first liquid constituents known percentage of air. Then, a second, cryogenic liquid constituent, predominantly comprising the other of oxygen or nitrogen, is loaded into the mixing container to completely fill the interior container volume intended to hold liquid. The percentage of the interior volume occupied by the second liquid constituent corresponds approximately to the known percentage of air of the second liquid constituent. The percentages can be adjusted to make the mixture richer in oxygen to insure that the mixture is at least twenty-one percent oxygen and to account for variations in the concentration of the oxygen related to time and other factors.

2. Prior Art

It is known that space requirements and container weight can be substantially reduced for gas storage and delivery systems involving relatively large volumes by maintaining the gas in the more dense liquid phase rather than as a gas or a supercritical fluid. When the liquefied gas is intended to be a breathable gas or in any system intended to contain multi-constituent gases of different boiling points, the conventional practice is to mix the various liquid constituents and store the mixture in a main storage tank. However, when multi-constituent liquefied gases are stored in insulated containers over relatively extended time periods, inevitable heat input to the stored liquid tends to cause evaporation. With multi-constituent liquefied gases of different boiling temperatures, this evaporation will change the relative composition of the stored liquid. Specifically, liquid constituents having lower boiling points will tend to evaporate preferentially resulting in vapor in the container being relatively richer in those constituents with the remaining liquid being leaner in constituents having lower boiling points.

The mixing container of the present invention is an improvement in filling and storing a multi-constituent liquid in that it enables the liquid, for example, a liquefied breathable gas mixture such as liquid air predominantly comprising oxygen and nitrogen to be mixed only at such time as it is anticipated that the breathable gas will be used in the near future. During periods of extended storage, the oxygen and nitrogen liquid constituents can be separately held in dedicated bulk storage containers. That way, the inevitable heat transfer to each of the stored liquid constituents will not result in any change in the composition of the liquid or its gaseous head. Then, at such time as it is anticipated that a liquefied, breathable gas mixture will be needed, the oxygen and nitrogen liquid constituents are filled into the mixing container of the present invention.

The thusly prepared liquid mixture can then be dispensed from the mixing container and gasified for use or, the mixing container can be used to fill the liquid mixture or its gaseous state into other cylinders such as the kind typically used in self-contained breathing apparatus (SCBA) and the like. If the interim period between filling and use is not too prolonged, the liquid and/or gaseous mixture will comprise its constituents within acceptable intended percentages. Also, the present mixing container is constructed such that filling the liquid constituents therein automatically results in a liquid mixture comprising each of the constituents in their intended respective percentages.

SUMMARY OF THE INVENTION

The present invention is thus directed to a mixing container for providing a multi-constituent liquid, preferably a cryogenic liquid air mixture filled in the container. The mixing container has at least two vent conduits communicating between respective fill positions or levels inside the container and the outside thereof. A first liquid, which is preferably nitrogen, is filled into the mixing container through a fill conduit until the first liquid contacts the first vent conduit disposed at a first level inside the container. The nitrogen then communicates through the first vent conduit and blows off through a vent valve. This valve is closed and liquid oxygen is then introduced into the mixing container through the fill conduit until the quantity of the liquid oxygen and liquid nitrogen mixture in the container contacts the second vent conduit disposed at a second level inside the container, spaced from the first level. The combined liquid oxygen and nitrogen mixture then communicates through the second vent conduit and blows off through a second vent valve. The second vent valve and a valve for the fill conduit are closed to complete the filling procedure.

The sequence for introducing the two liquids can be reversed. In that case, liquid oxygen having a boiling point of about −300° F. is first loaded into the cryogenic mixing container followed by the liquid nitrogen having a boiling point of about −320° F. Thus, the liquid nitrogen will boil relatively little of the liquid oxygen off of the mixture. However, liquid nitrogen is non-flammable and when it is loaded first, it acts as a diluent for the liquid oxygen to thereby lessen the probability of a fire.

By addition of a mechanical refrigerator, the mixing tank of the present invention can be made into a zero loss liquid-air container that can be stored for extended periods of time without changing the percentage of oxygen in the mixture.

The foregoing and additional advantages are characterizing features of the present invention that will become clearly apparent upon a reading of the ensuing detailed description together with the included drawings wherein:

DETAILED DESCRIPTION OF THE INVENTION

Figure 1:
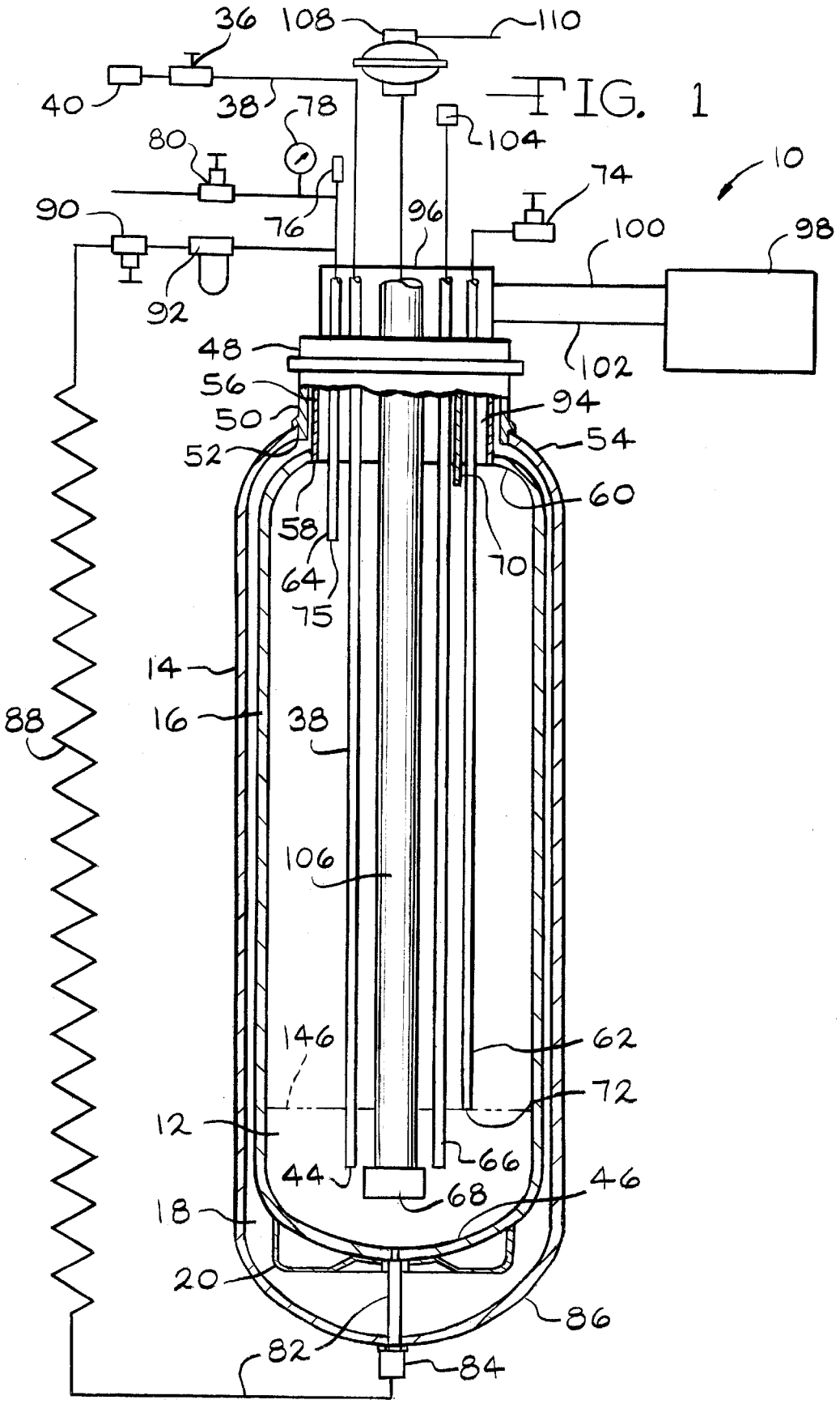
FIG. 1 is a perspective view, partly in schematic, of a Dewar, mixing container 10 having a liquid fill system according to the present invention and partially filled with a first, cryogenic liquid constituent.
Figure 2:
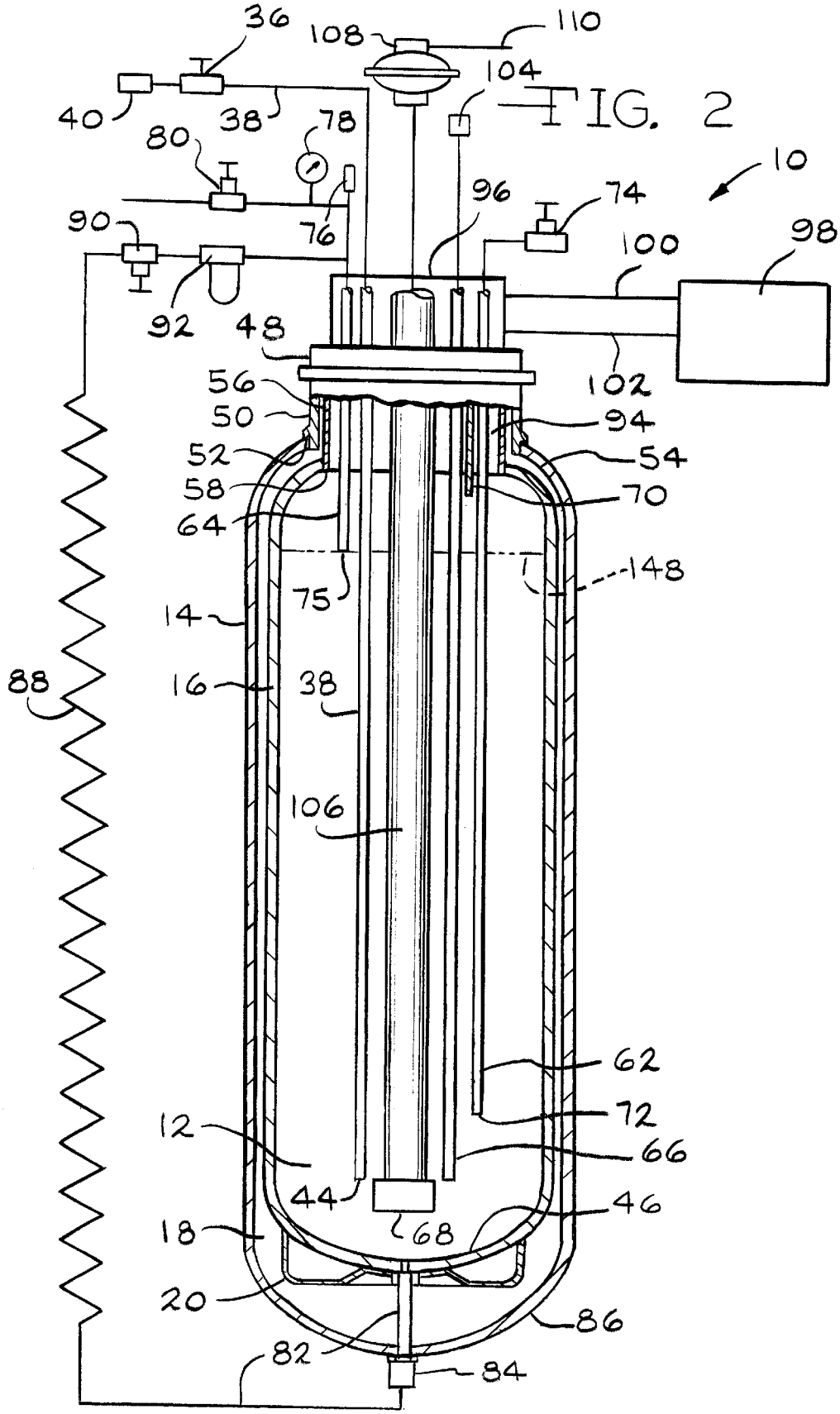
FIG. 2 is a perspective view, partly in schematic, of the mixing container shown in FIG. 1 filled with a mixture of first and second cryogenic liquid constituents.

Turning now to the drawings, FIGS. 1 and 2 show a Dewar, mixing container 10, partly in perspective view, partly in schematic, for providing a multi-constituent liquid 12 filled therein in intended proportions according to the present invention. The mixing container 10 can be permanently mounted, or it can be provided with casters (not shown) so that the container is mobile. Alternatively, the mixing container can be a portable unit, such as of the size that can be harnessed onto a person's back. The multi-constituent liquid 12 is preferably a cryogenic liquid such as a liquefied breathable gas, however, that is not required. In its broadest sense, mixing container 10 is useful for providing any multi-constituent liquid with the respective constituents in intended percentages or proportions.

The mixing container 10 comprises an outer container means or outer shell 14 mounted around and surrounding an inner container means or inner shell 16 for holding the cryogenic, multi-constituent liquefied-gas having an enriched oxygen concentration that serves as a breathable gas supply. The space 18 formed between the outer and inner shells 14 and 16 is evacuated to a prescribed level relative to ambient pressure and provided with an insulation material (not shown) that helps thermally insulate the cryogenic liquid 12. This insulation structure is typically referred to as super insulation and is commonly used in the construction of liquefied-gas containers. A getter material 20 is mounted on the outside of the inner shell 16 to absorb any residual gases in the evacuated space 18 between the shells 14 and 16 by a sorption process.

Figure 3:
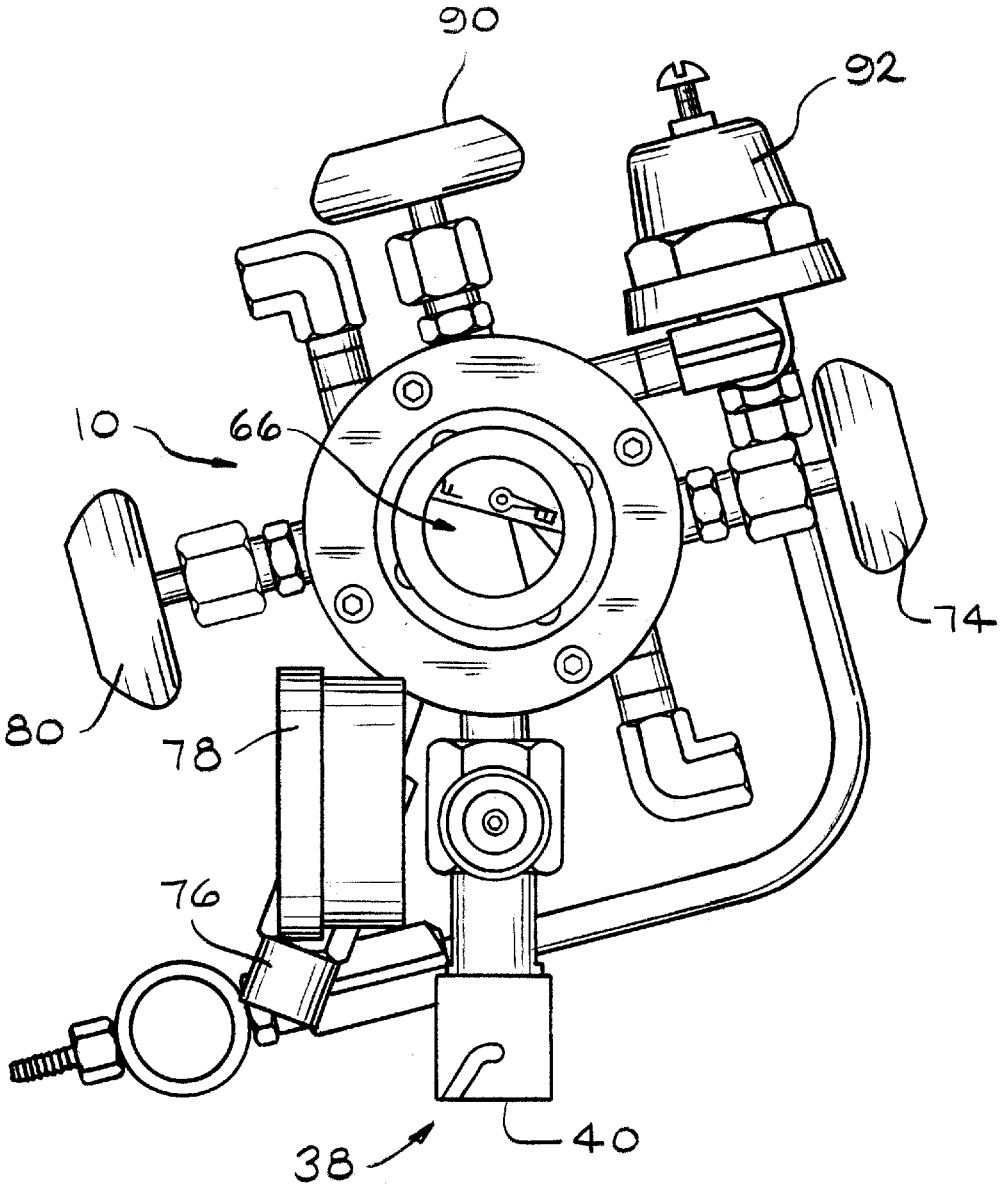
FIG. 3 is a plan view of the top of the mixing container of the present invention; and, FIG. 4 is a schematic diagram of a high pressure cryogenic liquid pumping system including the present mixing container 10 provided for delivering of a cryogenic liquid mixture to a utilization system 28.
Figure 4:
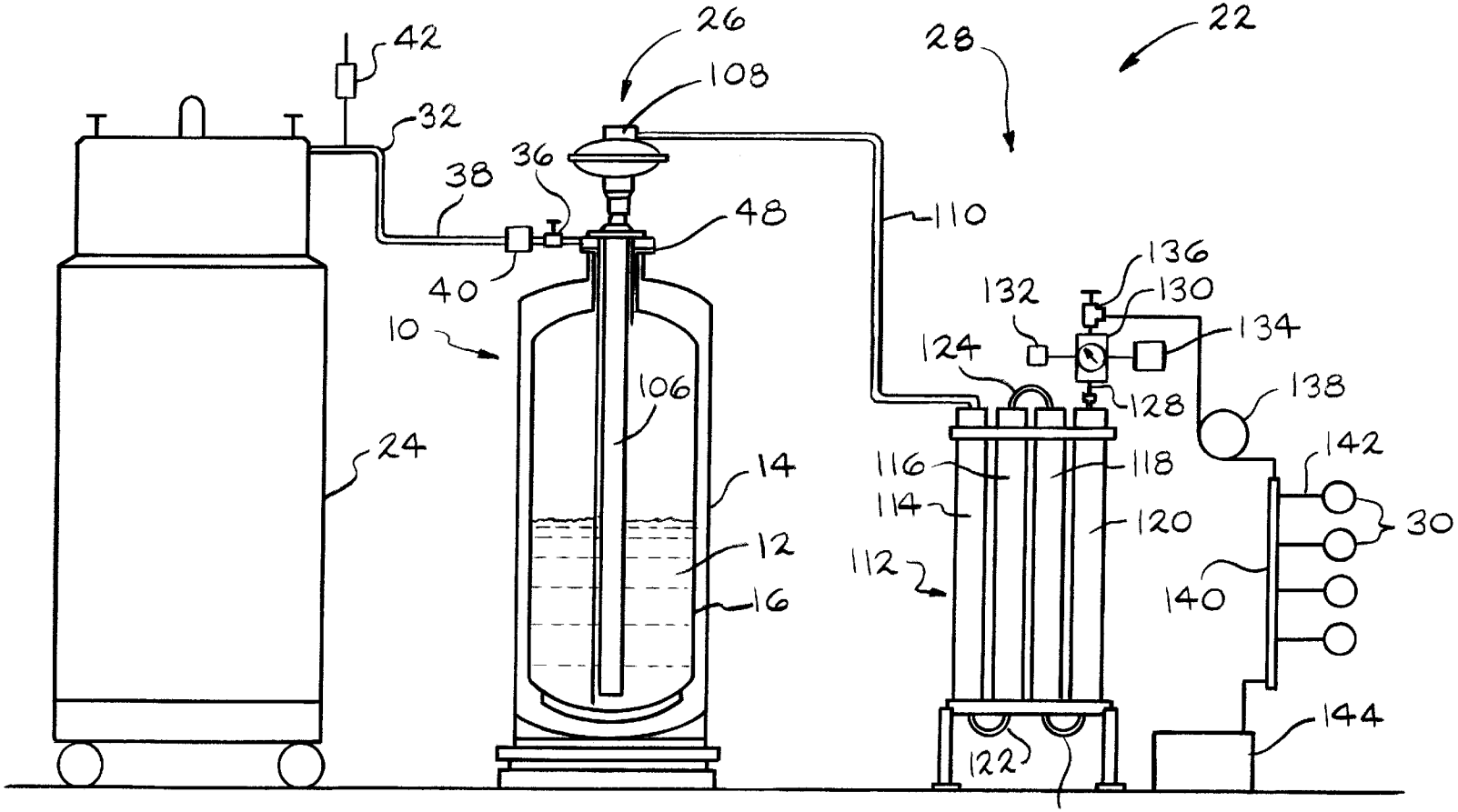

Referring to FIGS. 3–4, the mixing container 10 comprises part of a high pressure cryogenic liquid pumping system 22. The total system 22 includes two or more bulk storage containers 24, a high pressure pumping system 26, which serves to transfer cryogenic liquid from the mixing container 10 to a high pressure utilization system 28 for filling personal air cylinders 30 with a breathable gas mixture.

During use of the high pressure cryogenic liquid pumping system 22, the pressure normally maintained in the several bulk storage containers 24 causes the stored cryogenic liquid such as liquid oxygen (LOX) or liquid nitrogen to flow from them through a feed hose 32 and a manually operated fill valve 36 to a liquid fill conduit 38 having a coupling 40 adapted to connect the mixing container 10 to the various storage containers 24. A pressure relief valve 42 in feed hose 32 limits the pressure of the cryogenic liquid in the feed hose 32. The fill conduit 38 terminates at an open end 44 disposed inside the inner shell 16 at a height determined by the desired percentages of the mixture. The fill conduit 38 is supported by a container flange 48 threaded on an upper end of an annular neck 50 secured to the perimeter of a first opening 52 provided in an upper dome 54 of the outer shell 14. A cylindrically shaped sleeve inner neck support 56 is mounted to the perimeter of a second opening 58 in an upper dome 60 of the inner shell 16, spaced inwardly from the annular neck 50 and aligned along the longitudinal axis of the mixing container 10. The sleeve 56 helps to support the inner container 16 from the lower flange and adds stability to the mixing container 10 at the upper end thereof.

The container flange 48 also supports a first liquid blow off conduit 62, a second liquid blow off conduit 64, a liquid quantity sensor 66, a high pressure piston pump 68 comprising part of the high pressure pumping system 26 and a recondensor finger 70. The first liquid blow off conduit 62 has an open end 72 disposed inside the inner shell 16 at a first level or altitude when the mixing container 10 is oriented in the fill position, as shown in FIGS. 1 and 2. A vent valve 74 provides for opening and closing fluid flow communication through the first liquid blow off conduit 62. The second liquid blow off conduit 64 has an open end 75 disposed inside the inner shell 16 at a second level or altitude, spaced above the first altitude of opening 72 when the mixing container 10 is in the fill position. The second liquid blow off conduit 64 includes a pressure relief valve 76, a pressure gauge 78 and a vent valve 80 for opening and closing fluid flow communication therethrough.

As shown schematically in FIGS. 1 and 2, an output fluid conduit 82 extends from the lower dome 46 of the inner shell 16 to a valve 84 located on a lower dome 86 of the outer shell 14. Conduit 82 leads to a heat exchanger means 88 which in turn connects to a pressure building valve 90 and a pressure building regulator 92 leading to the second liquid conduit 64. The output fluid conduit 82 and heat exchanger means 88 serve to maintain a head pressure in the ullage space 94 above the liquid by drawing off some of the cryogenic liquid 12 from the mixing container 10. As the cryogenic liquid flows through the pressure building conduit 82 and heat exchanger 88, heat energy is transferred thereto to vaporize the drawn off liquid. The thusly formed gas then flows into the ullage 94 to raise the pressure in the container 10. This continues until the internal pressure reaches a pressure threshold at which time valve 92 closes to discontinue pressure building. Preferably the valve 92 is set to regulate a pressure of about eighty-five psig. Should the internal pressure exceed the pressure threshold, the relief valve 76 will open to relieve some of the built up pressure. For a more detailed description of the "pressure building system", reference is made to U.S. Pat. No. 4,674,289 to Andonian, the disclosure of which is incorporated herein by reference.

A liquid refrigerant circulates through the recondensor finger 70 leading to a cold head 96 connected to a compressor 98 via an outlet conduit 100 and a return conduit 102 providing a refrigeration system for the mixing container 10. More specifically, the refrigerant helium gas flows from the compressor 98 to the recondensor finger 70 via conduit 102 which serves as a high pressure line. In the cold head 96, the helium gas refrigerant passes through a expansion device (not shown) and emerges in the recondensor finger 70 as a vapor at a relatively low temperature. In the finger 70, heat is removed from the ullage 94 condensing vapor to liquid. The recirculating helium refrigerant enters compressor 98 via low pressure line 100 to repeat the cycle. The compressor 98 is powered either by a centrifugal or positive displacement motor (not shown). That way, the pressure building system in conjunction with the refrigeration system maintain the pressure in the inner shell 16 in a relatively steady state pressure range of about eighty-five psig with zero loss of the contents in the inner shell 16 and therefore no change in the composition of the gas mixture.

The liquid quantity sensor is schematically shown at 66 having a gauge 104 for indicating the level of the cryogenic liquid 12 inside the mixing container 10. Quantity sensor 66 is representative of known electrical means for detecting a liquid quantity and typically includes two elongated parallel electrodes which are spaced apart from one another and are stabilized from contact with the inner shell 14. In order to provide an accurate reading of the liquid quantity, the electrodes extend between a position proximate the lower dome 46 of the inner shell 16 and exit the mixing container 10 through an insulated member in flange 48. An exemplary liquid gauge is described in U.S. Pat. No. 3,943,767 to Efferson, the disclosure of which is included herein by reference.

In another configuration, a pump is added to the system for filling liquid-gas mixtures into high pressure cylinders.

The high pressure pumping system 26 includes a high pressure piston pump 68, shown schematically in FIGS. 1 and 2, supported adjacent to the lower dome 46 of the inner shell 16 by a pump casing 106 so that the pump is immersed in the cryogenic liquid that it pumps. This serves to cool the pump 68 to help minimize cavitation or boiling at the pump input which can occur when the piston is actuated to pump the cryogenic liquid 12. A more detailed description of the high pressure piston pump 68 is found in U.S. Pat. No. 5,819,544 to Andonian, the disclosure of which is hereby incorporated by reference.

The pump casing 106 extends upward from the pump 68 to a pneumatic drive head assembly 108 that forces the cryogenic liquid 12 moved thereto by pump 68 to feed the utilization system 28 via line 110, for example, for filling personal air cylinders 30 with evaporated cryogenic liquid oxygen at pressures up to about 3,500 psig. As an alternative, an electric motor driven cam can be used as an alternative to a pneumatic drive. In order to minimize the net positive suction head required for pump operation, the drive must be designed to push the piston down. Pressure in the container is used to push the piston up.

The high pressure liquefied breathable gas in line 110 is fed to vaporizer bank 112 which includes several lengths of finned tubes 114, 116, 118 and 120 connected in series by connections 122, 124 and 126 from finned tube to finned tube.

These finned tubes are highly thermally conductive and are heated by ambient air to completely vaporize the liquefied breathable gas to a gaseous state. At the last finned tube 120, high pressure oxygen gas flows from the tube in gas line 128 through a pressure gauge (4,000 psig.) 130, past safety valve (3,500 psig.) 132 and pressure switch (3,100 psig.) 134, to shut-off valve and burst disk 136. From valve 136 the gas flows through a pigtail line 138 to gas cylinder fill manifold 140 to fill the personal air cylinders 30 with the breathable gas, each through one of cylinder lines 142 feeding from the manifold 140.

A vacuum pump 144 also connects to the cylinder manifold 140 and serves to evacuate the gas filling system back to valve 136 of the utilization system 28. Evacuation by vacuum pump 144 can also be extended through the vaporizer bank 112 and high pressure cryogenic liquid line 110. clearly, if purging gas is introduced into the feed hose 32 and fill conduit 38 with valve 36 open, the entire system including the mixing container 10 and the bulk storage container 24 are evacuated.

In Use

Filling mixing container 10 with a two constituent liquid begins by opening the first vent valve 74 and connecting the fill coupling 40 to one of the bulk storage tanks 24 holding the first liquid constituent. With cryogenic liquid filling into mixing container 10 through fill conduit 38 and with vent valve 74 open, at such time as the first liquid constituent contacts opening 72 and communicates through the first liquid conduit 62 to blow off or vent through valve 74, the mixing container 10 is filled with the first liquid constituent approximately to a level indicated at 146 in FIG. 1 corresponding to the altitude of opening 72. Vent valve 74 is then closed, and coupling 40 is decoupled for the first bulk storage tank 24 and connected to a second bulk storage tank 24 holding the second liquid constituent. With vent valve 80 open, the second liquid is filled into the mixing container 10 through fill conduit 38 until such time as the mixture of the first and second liquid constituents contacts opening 75 and communicates through the second liquid conduit 64 to blow off or vent through valve 80. Mixing container 10 is now filled with the two liquids to a level approximately corresponding to the altitude of the opening 75, as indicated at 148 in FIG. 2. The level of opening 75 in conduit 64 is positioned to provide the ullage space 94 at the upper portion of the inner shell 14 where a gas pocket forms that prevents the mixing container 10 from being overfilled with liquid and which provides for the maintenance of a head vapor having gaseous components similar in concentration to the formulation of the constituents in the liquid.

It should be understood that in those situations when the two constituent liquid filled into the mixing container 10 is intended to be a breathable liquefied-gas mixture, the liquid conduits 62 and 64 are preferably positioned inside the inner shell 14 so that upon filling, measured quantities of liquefied oxygen and liquefied nitrogen are automatically filled into the container in percentages corresponding approximately to their respective makeup of air. For example, in the case where nitrogen is the first liquid constituent loaded or filled into the mixing container, the volume of the inner shell 14 filled up to line 146 in FIG. 1 is approximately 79% of the total volume of the inner shell intended to hold liquid and the volume between line 146 and line 148 is approximately 21% of the total liquid volume. Loading nitrogen into the inner shell 14 is preferred since this gas is non-flammable and serves as a diluent for the later loaded oxygen constituent. On the other hand, liquid nitrogen has a boiling point of about −320° F. while liquid oxygen has a boiling point of about −300° F. If liquid nitrogen is loaded into the inner shell 14 first, as the higher boiling point liquid oxygen is added it will cause some of the low boiling point liquid oxygen to boil off and vaporize. If liquid oxygen is loaded first, the volume of the inner shell 14 up to line 146 is approximately 21% of the total volume intended to hold cryogenic liquid and the volume between line 146 to line 148 is approximately 79% of the total liquid volume.

It should also be understood that in its broadest form, the mixing container 10 of the present invention is not required to have the fill conduit 38. In that case, the first liquid constituent is first loaded into the inner shell 14 through the second liquid conduit 64 until it contacts opening 72 in the first liquid conduit 62 to blow off or vent through valve 74. Then, the second liquid conduit 64 is disconnected from the first liquid bulk storage tank 24 and the first liquid conduit 62 is connected the second bulk storage tank. The second liquid constituent is now loaded or filled into the inner shell 14 until the mixture of the two liquids contacts opening 75 in the second liquid conduit 64 and communicates to the outside of the mixing container therethrough. To complete the procedure, the first liquid conduit 62 is disconnected from the second storage tank and the vent valves 74 and 80 are closed.

Thus, operation of the entire system shown in FIG. 4 to pump cryogenic liquid from the various liquid bulk storage tanks 24 to the utilization system 28 via the high pressure pumping system 26, may be done in two steps. First, cryogenic liquid is moved from the bulk storage tanks 24 via fill hose 32 and check valve 34 to the mixing container 10 as previously described by the pressure normally maintained inside the storage tanks. Then, once the multi-constituent liquid is provided in the mixing container 10, such as the breathable gas mixture of nitrogen and oxygen, the fill line 38 is closed and the pump system 26 and gas utilization system 28 are turned on, filling the high pressure gas cylinders 30. This continues until the quantity of cryogenic liquid in the mixing container 10 falls below the input of high pressure piston pump 68, at which point pump 68 automatically shuts off. Then, the steps of refilling the mixing container 10 with the breathable liquefied gas 12 and filling the high pressure gas cylinders 30 are repeated.

It is appreciated that various modifications to the inventive concepts described herein may be apparent to those skilled in the art without departing from the spirit and the scope of the present invention defined by the hereinafter appended claims.

What is claimed is:

1. An apparatus for providing a liquid having at least two liquid constituents, which comprises:

a) a closed container means;

b) a first conduit means communicating between the interior and the outside of the container means and having a first opening disposed inside the container means at a first position; and c) a second conduit means communicating between the interior of the container means and the outside thereof and having a second opening disposed inside the container means at a second position spaced apart from the first position of the first opening, wherein with the container means oriented such that the second position is at a higher altitude than the first position and with fluid flow communicable between the interior and the outside of the container means through the first conduit means and the second conduit means, a first liquid constituent is fillable into the container means through the second conduit means until the first liquid constituent communicates to the outside of the container means through the first conduit means, and wherein a second liquid constituent is then fillable into the container means through the first conduit means until the combined first and second liquid constituents communicate to the outside of the container means through the second conduit means, and wherein communication through the first conduit means and the second conduit means is closable.

2. The apparatus of claim 1 wherein the container means is sized such that with the second position at a higher altitude than the first position, a first volume of the container means below the first opening of the first conduit means consists of a first percentage of a total volume of the container means intended to be occupied by the liquid and wherein a second volume of the container means between the second opening of the second conduit means and the first opening of the first conduit means consists of a second percentage of the total volume of the container means intended to be occupied by the liquid.

3. The apparatus of claim 2 wherein the container means is intended to hold a breathable, liquefied-gas mixture with the first volume comprising about 65% of the total volume intended to be occupied by the liquid and wherein the second volume comprises about 35% of the total volume of the container means intended to be occupied by the liquid.

4. An apparatus for providing a liquid having at least two liquid constituents, which comprises:

a) a closed container means;

b) a fill conduit means communicating between an interior of the container means and the outside thereof;

c) a first conduit means communicating between the interior and the outside of the container means and having a first opening disposed inside the container means at a first position; and d) a second conduit means communicating between the interior of the container means and the outside thereof and having a second opening disposed inside the container means at a second position spaced apart from the first position of the first opening, wherein with the container means oriented such that the second position is at a higher altitude than the first position and with fluid flow communicable between the interior and the outside of the container means through the fill conduit means, the first conduit means and the second conduit means, a first liquid constituent is fillable into the container means through the fill conduit means until the first liquid constituent communicates to the outside of the container means through the first conduit means, and wherein with communication through the first conduit means closed, a second liquid constituent is fillable into the container means through the fill conduit means until the combined first and second liquid constituents communicate to the outside of the container means through the second conduit means, and wherein communication through the fill conduit means and the second conduit means is closable.

5. The apparatus of claim 4 wherein the container means is sized such that with the second position at a higher altitude than the first position, a first volume of the container means below the first opening of the first conduit means consists of a first percentage of a total volume of the container means intended to be occupied by the liquid and wherein a second volume of the container means between the second opening of the second conduit means and the first opening of the first conduit means consists of a second percentage of the total volume of the container means intended to be occupied by the liquid.

6. The apparatus of claim 4 wherein the container means is intended to hold a breathable, liquefied-gas mixture with the first volume comprising about 65% of the total volume intended to be occupied by the liquid and wherein the second volume comprises about 35% of the total volume of the container means intended to be occupied by the liquid.

7. An apparatus for providing a liquid having at least two liquid constituents, which comprises:

a) a closed container means;

b) a first conduit means communicating between an interior of the container means and the outside thereof and having a first opening disposed inside the container means at a first altitude;

c) a second conduit means communicating between the interior and the outside of the container means and having a second opening disposed inside the container means at a second altitude spaced above the first altitude of the first opening;

d) a third conduit means communicating between the interior of the container means and the outside thereof and having a third opening disposed inside the container means at a third altitude spaced above the second altitude of the second opening, wherein with fluid flow communicable between the interior and the outside of the container means through the first conduit means, the second conduit means and the third conduit means, a first cryogenic liquid constituent predominantly comprising one of oxygen or nitrogen is fillable into the container means through the first conduit means until the first liquid constituent communicates to the outside of the container means through the second conduit means, and wherein with communication through the second conduit means closed, a second cryogenic liquid constituent predominantly comprising the other of oxygen or nitrogen is fillable into the container means through the first conduit means until the combined first and second liquid constituents communicate to the outside of the container means through the third conduit means, and wherein communication through the first conduit means and third conduit means is closable.

8. The apparatus of claim 7 wherein the container means includes an inner container means provided to store the cryogenic liquid and an insulation means housing the inner container means in a surrounding relationship to retard ambient heat conduction and radiation to the cryogenic liquid inside the inner container means.

9. The apparatus of claim 8 wherein the insulation means is comprised of the outer container means housing the inner container means in the surrounding relationship with an insulation material disposed in a space provided between the inner and outer container means.

10. The apparatus of claim 8 wherein the inner container means is comprised of a surrounding inside sidewall having opposed ends along a longitudinal axis closed by a first and a second closure means and wherein the first and second closure means are spherical—or ellipsoidal-shaped dome members that close the opposed ends of the cylinder.

11. The apparatus of claim 7 further including a vent means that opens communication between the interior and the outside of the container means when the pressure inside the container means exceeds a predetermined level.

12. The apparatus of claim 7 wherein the container means is selectively connectable to bulk storage containers holding the first and second cryogenic liquid constituents.

13. The apparatus of claim 7 wherein the container means includes a pressure building means for maintaining a head pressure in the container means.

14. The apparatus of claim 7 wherein the container means includes a recondensor means for recondensing a portion of the vapor in an ullage space of the container means.

15. The apparatus of claim 7 wherein the container means includes a pressure building means for maintaining a head pressure therein and a recondensor means for recondensing a portion of the vapor in a ullage space of the container means and wherein the pressure building means and the recondensor means cooperate to maintain the head pressure in the container means at eighty-five psig.

16. The apparatus of claim 7 connected to a plurality of personal gas cylinders for filling the gas cylinders with a breathable gas.

17. The apparatus of claim 7 as a portable apparatus intended to be harnessed on a user's back as part of a self contained breathing apparatus.

18. A method of providing a liquid having at least two liquid constituents, comprising the steps of:

a) providing a closed container means having at least a first conduit means and a second conduit means, both communicating between the outside of the container means and the interior thereof, wherein a first opening of the first conduit means is disposed inside the container means spaced apart from a second opening of the second conduit means;

b) orientating the container means into a fill position such that the first opening of the first conduit means is disposed at a first altitude and the second opening of the second conduit means is disposed at a second altitude spaced above the first altitude;

c) filling a first liquid constituent into the container means through the second conduit means until the first liquid constituent communicates between the interior of the container means and the outside thereof through the first conduit means;

d) filling a second liquid constituent into the container means through the first conduit means until the combined first and second liquid constituents communicate between the interior of the container means and the outside thereof through the second conduit means; and e) closing fluid flow communication through the first conduit means and the second conduit means.

19. The method of claim 18 including providing a first volume portion of the container means below the first opening of the first conduit means consisting of a first percentage of a total volume of the container means intended to hold liquid and providing a second volume portion of the container means between the first opening and the second opening consisting of a second percentage of the total volume such that the ratio of the first percentage to the second percentage is directly proportional to the percentage of the liquid intended to be provided by the first and second liquid constituents, respectively.

20. A method of providing a liquid having at least two liquid constituents, comprising the steps of:

a) providing a closed container means having a fill conduit means, a first conduit means and a second conduit means, all communicating between the outside of the container means and the interior thereof, wherein a first opening of the first conduit means is disposed inside the container means spaced apart from a second opening of the second conduit means;

b) orientating the container means into a fill position such that the first opening of the first conduit means is disposed at a first altitude and the second opening of the second conduit means is disposed at a second altitude spaced above the first altitude;

c) filling a first liquid constituent into the container means through the fill conduit means with fluid flow communication through the first conduit means open until the first liquid constituent contacts the first opening and communications between the interior of the container means and the outside thereof through the first conduit means;

d) closing off fluid flow communication through the first conduit means;

e) filling a second liquid constituent into the container means through the fill conduit means with fluid flow communication through the second conduit means open until the combined first and second liquid constituents contact the second opening and communicate between the interior of the container means and the outside thereof through the second conduit means; and f) closing fluid flow communication through the fill conduit means and the second conduit means.

21. The method of claim 20 including providing the liquid as a cryogenic liquid comprised of a breathable liquefied-gas mixture comprising oxygen and nitrogen.

22. The method of claim 21 including providing a first volume portion of the container means below the first opening of the first conduit means consisting of a first percentage of a total volume of the container means intended to hold liquid and providing a second volume portion of the container means between the first opening and the second opening consisting of a second percentage of the total volume such that the ratio of the first percentage to the second percentage is directly proportional to the percentage of oxygen and nitrogen, respectively, in the breathable, liquefied-gas mixture.

23. The method of claim 22 including providing the first liquid constituent as nitrogen with the first volume comprising about 65% as the first percentage of the total volume and providing the second liquid constituent as oxygen with the second volume comprising about 35% as the second percentage.

24. A method of providing a liquid having at least two liquid constituents, comprising the steps of:

a) providing a closed container means having a first conduit means, a second conduit means and a third conduit means, all communicating between the outside of the container means and the interior thereof, wherein a first opening of the first conduit means is disposed inside the container means spaced apart from a second opening of the second conduit means and wherein a third opening of the third conduit means is spaced apart from the first opening and the second opening;

b) orientating the container means into a fill position such that the first opening of the first conduit means is disposed at a first altitude, the second opening of the second conduit means is disposed at a second altitude spaced above the first altitude and the third opening of the third conduit means is disposed at a third altitude spaced above the second altitude;

c) filling a first cryogenic liquid constituent predominantly comprising one of oxygen or nitrogen into the container means through the first conduit means with fluid flow communication opening through the second conduit means until the first liquid constituent contacts the second opening and communicated between the interior of the container means and the outside thereof through the second conduit means;

d) closing off fluid flow communication through the second conduit means;

e) filling a second cryogenic liquid constituent predominantly comprising the other of oxygen and nitrogen into the container means through the first conduit means with fluid flow communication open through the third conduit means until the combined first and second cryogenic liquid constituents contact the third opening and communicate between the interior of the container means and the outside thereof through the third conduit means; and f) closing off fluid flow communication through the first conduit means and the third conduit means.

25. The method of claim 24 including providing a first volume of the container means below the second opening of the second conduit means consisting of a first volume portion of a total volume of the container means and providing a second volume portion of the total volume of the container means between the second opening and the third opening such that the ratio of the first volume portion to the second volume portion is directly proportional to a first percentage and a second percentage of the liquid provided by the first and second cryogenic liquid constituents, respectively.

26. The method of claim 24 including providing the first cryogenic liquid constituent as nitrogen with the first volume portion comprising about 65% as the first percentage of the total volume and providing the second cryogenic liquid constituent as oxygen with the second volume portion comprising about 35% as the second percentage.

* * * * *